United States Patent [19]

Sandrin

[11] Patent Number: 5,050,591

[45] Date of Patent: Sep. 24, 1991

[54] FLEXIBLE WATER MASSAGE MAT

[75] Inventor: Giannino Sandrin, Pordenone, Italy

[73] Assignee: Albatros System S.p.A., Spilimbergo, Italy

[21] Appl. No.: 518,542

[22] Filed: May 3, 1990

[30] Foreign Application Priority Data

May 5, 1989 [IT] Italy ..... 45726A/89

[51] Int. Cl.[5] ..... A61H 9/00; A61H 23/00; A47K 3/12; A47C 27/08

[52] U.S. Cl. ..... 128/65; 128/66; 128/24 R; 4/575; 4/582; 5/451

[58] Field of Search ..... 128/64, 65, 66, 24 R; 5/451, 453, 455; 4/541-547, 571, 573, 580, 581, 582, 575

[56] References Cited

U.S. PATENT DOCUMENTS

| | | | |
|---|---|---|---|
| 3,420,227 | 1/1969 | Voorlas | 128/66 |
| 3,579,659 | 5/1971 | Baumann | 128/66 X |
| 4,048,266 | 9/1977 | Baumann | 4/581 X |
| 4,122,846 | 10/1978 | Baumann | 4/581 X |
| 4,269,797 | 5/1981 | Mikiya et al. | 128/66 X |
| 4,417,568 | 11/1983 | Nozawa et al. | 128/66 X |
| 4,625,715 | 12/1986 | Bucher | 128/66 |
| 4,780,916 | 11/1988 | Sutton | 128/66 X |

FOREIGN PATENT DOCUMENTS

| | | | |
|---|---|---|---|
| 3331684 | 3/1985 | Fed. Rep. of Germany | 4/581 |

*Primary Examiner*—Edgar S. Burr
*Assistant Examiner*—Moshe I. Cohen
*Attorney, Agent, or Firm*—Wenderoth, Lind & Ponack

[57] ABSTRACT

A water massage mat is disclosed which comprises a substantially rectangular cover formed of two leaves of suitable flexible material welded together along weld lines so as to form a structure similar to a small air mattress. The weld lines include a perimetrical weld line extending along the perimeter of the cover and a second internal weld line configured so as to define a first hermetically sealed channel and a second channel closed at one of its ends and connected at its other end to a feeder pipe which is adapted to be connected to a source of compressed air. These internal weld lines, as viewed from above are serpentine shaped. Small holes are formed in the upper surface of the second channel and are capable of allowing the compressed air from the feeder pipe to flow out of the second channel so as to generate a water massage effect. A plurality of suction cups fasten the cover to the bottom of a tub or basin. The first and second channels are formed such that, when inflated, the first channel is larger in diameter than the second channel, and the upper surface of the second channel is vertically lower than the upper surface of the first channel. With this arrangement, the user's body can be supported by the first channel with a gap formed above the small holes of the second channel to allow air to flow therethrough.

16 Claims, 1 Drawing Sheet

FLEXIBLE WATER MASSAGE MAT

BACKGROUND OF THE INVENTION

This invention has the objective of providing a new mat for water massages which includes a covering formed of two thin leaves of suitable flexible material welded to each other in such a way as to form a small soft mattress. The mattress is preferably rectangular in shape and can be supported and set on the bottom of an ordinary bathtub or other similar facility. The two leaves are welded together in such a manner as to form a channel provided with small holes therethrough which, when suitably fed in a known manner with air which may be ozonized and/or mixed with other suitable gaseous additives, generates in water contained in the bathtub a fine diffusion of small bubbles of air. In this manner, a water massage effect is obtained.

Various apparatus for hygienic-sanitary treatments, commonly called "water massages", are well known. Some such apparatus make use of jets of water mixed with air which may be suitably ozonized. The jets of water can be generated by particular nozzles variously arranged in corresponding tubs or small pools, and suitably directed to penetrate through the water contained in the tubs or small pools.

Another well known water massage apparatus, which has been in widespread use for some time utilizes an element composed of a grating or rigid mat arranged on the bottom of a common bathtub. This element is normally formed of tubular elements, or other differently shaped hollow elements, suitably interconnected with each other. These elements have suitable holes formed therein and are fed with compressed air, so as to generate a plurality of small bubbles in water contained in the tub in order to provide a water massage.

As is known, the various water massage apparatus have, up to now, utilized rigid tubular elements interconnected by either rigid tubular elements or other differently shaped rigid hollow elements.

These prior art apparatus have several drawbacks. For example, the rigid surfaces of the apparatus upon which the person being treated must lie cause localized pressures against the person's body, thereby resulting in an unpleasant overall effect. This is often exacerbated because the person is restricted in his movements. In addition, the apparatus which employ gratings are often utilized only for fixed installations because such gratings are not normally dismountable, or the mounting and dismounting of the grating is notably difficult and complex. Even when disassembled these gratings are generally cumbersome.

Furthermore, water massage apparatus which utilize mats formed of hollow elements which, when suitably formed and connected, allow a fairly good and simple refilling, are always notably cumbersome when filled.

SUMMARY OF THE INVENTION

The object of this invention is to provide a water massage apparatus which does not suffer from the above drawbacks. This object is obtained by the present invention with the provision of a mat which is formed of a flexible covering of suitable shape and dimensions for the bottom of a suitable basin, normally an ordinary bathtub, a small pool or something similar. The flexible covering is formed in a manner which, in itself, is already known, such flexible covering including two leaves of suitable flexible material interconnected with each other along suitable weld lines. The welding can be carried out with elements and systems in themselves known, so as to obtain a structure similar to a common or well know air mattress. The covering is characterized by the fact that it includes one perimetrical weld line extending along its edges and an internal line developed in such a way as to form two distinct channels. A first of the two channels is hermetically sealed, and a second of the two channels is provided with a plurality of small holes in a surface thereof facing upwardly when the covering is arranged on the bottom of the basin. The first channel is provided with a hermetically sealable opening so that the first channel can be filled with water and/or air so as to form a soft mattress, and can also be emptied. The second channel is closed at one end and connected at the other end to a suitable compressed air feeder conduit for feeding air which may be ozonized and/or mixed with other suitable fluids. The compressed air is generated by means known in the art and is supplied to the second channel and discharged through the small holes, so as to cause a plurality of gaseous bubbles to be generated in the water contained in the basin. The bubbles ascend toward the top of the water in order to produce the desired water massage effect. The first channel has dimensions capable of developing a comfortable support surface for the body of the user, and the second channel has somewhat smaller dimensions than the first channel so that the corresponding outlet holes for the air do not come into contact with the user's body. The first channel has suitable cups mounted to a lower part thereof adjacent the bottom of the basin so as to immovably fasten the apparatus in the basin. The cups are preferably applied, suitably arranged and spaced, on only the lower part of the first channel.

BRIEF DESCRIPTION OF THE DRAWINGS

These and other characteristics and advantages that can be obtained with the water massage mat according to the present invention, will be more easily understood from the following description, in which a preferred embodiment of the mat of the invention is described only by way of example, with reference to the attached drawings, in which.

DETAILED DESCRIPTION OF THE INVENTION

Figure 4:
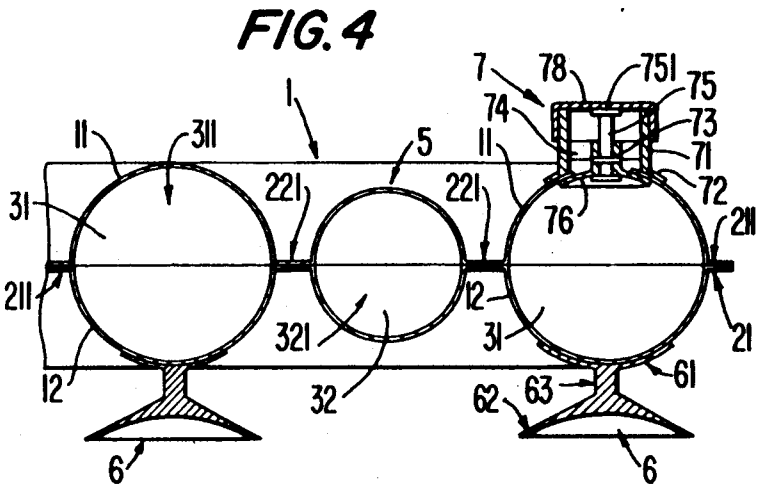
FIG. 4 is an enlarged partial cross-section view taken along the line III—III of FIG. 1.

In the drawing figures, common elements are identified with like reference numerals.

A preferred form of the invention, to which reference will be made hereinafter, is illustrated particularly in FIGS. 1 to 4. The water massage mat is composed of a rectangular cover 1 which is formed of two corresponding rectangular leaves (11, 12) of a suitable flexible and soft material, such as a rubber laminate, rubberized fabric, or a laminate of similar plastic material. The upper leaf 11 and lower leaf 12 are welded along a perimetrical line 21, including two longitudinal weld lines 211, a lower lateral weld line 212 and an upper lateral weld line 213.

One end of a feeder conduit 4 is connected at a central location along the lower end of the mat by way of a circumferential weld. The feeder conduit is preferably formed of a conventional flat flexible pipe 41. The other end of the feeder conduit 4 is adapted to be connected to a compressed air generator of a known type, possibly including a suitable ozoning device and/or devices for mixing other suitable fluids into the air. Such devices are known in the art.

Inside of the perimetrical weld line 21 additional welds are provided. More specifically, a plurality of internal parallel longitudinal welding lines 221 are provided and are parallel to the longitudinal weld lines 211. All of these weld lines are suitably spaced from one another. These internal longitudinal weld lines 221 are extended to locations near, but slightly spaced from, the lower lateral weld line 212 and the upper lateral weld line 213. At their lower ends, the internal longitudinal weld lines 221 ar alternately interconnected by lower lateral weld lines 222 and upper lateral weld lines 223 so as to form a serpentine track. The two laterally outwardmost of the internal longitudinal weld lines 221 extend to interconnect with the upper lateral weld line 213. A first end 411 of the feeder pipe 4 formed of the flat flexible pipe 41 is connected centrally of these two extended weld lines. The second end of the feeder pipe 4 is, of course, to be suitably connected to the previously mentioned compressed air generator.

The different lines described above are effective to define in the cover 1 a double channel configuration. More specifically, a first channel 31 is formed of longitudinal spaces 311 which interconnect at the lower end of the cover 1 by way of a lower collecter formed of transverse spaces 312. A second channel 32 is formed of longitudinal spaces 321 interconnected at the upper end of the cover 1 by way of an upper collector formed of transverse spaces 322, into the center of which the first end 411 of the feeder pipe 4 is connected.

As shown particularly in FIG. 4, in the upper part of the second channel 32 and more specifically in the upper part of the longitudinal spaces 311, there are formed a plurality of small holes 5 suitable for the function described below. Additionally, suction cups 6 are mounted on the external surface of the lower part of the first channel 31.

As shown in the drawing figures, the distances between the weld lines defining the channel 32 are less than the distances between the weld lines defining the first channel 31 such that, as described below, when the mat is in use, the conduits constituting the first channel 31 are larger than those constituting the second channel 32. With this arrangement, the body of the user can be supported by the conduits of the first channel 31 without interfering with the holes 5 of the second channel 32, in order to avoid impeding the operation of the mat 1 itself.

The cups 6, as illustrated in FIG. 4, are comprised of an upper concave element 61 and a lower conical trunk element 62, interconnected by a cylindrical handle 63. They are preferably formed of a suitable flexible material such as a natural or synthetic elastomer of a type known in the art. The upper concave element 61 will be suitably attached to the external surface of the lower wall (i.e. lower leaf 12) of the conduits of the longitudinal spaces 311. The fastening can be accomplished by any suitable known means, for example, by heat welding or the like. The lower conical trunk element 62 forms the cup portion which is adapted to contact the surface of the basin (bathtub) in which the mat will be supported, so as to immovably fasten the mat into the basin.

The first hermetically sealed channel 31 is provided with a port 7, illustrated in detail in FIG. 4, which is capable of allowing the mat to be filled with a suitable fluid, such as air and/or water, and to be emptied. With reference to FIG. 4, it is noted that the port 7 comprises a cylindrical tubular element 71 having an outwardly extending circumferential bottom flange 72 to be fastened preferably on the upper outside surface of the upper wall (i.e. upper leaf 11) of the channel 31. The fastening can be accomplished by any known means, such as for example, heat welding or the like. A cylindrical body 73 is mounted coaxially in the lower part of the cylindrical tubular element 71 and is of a suitably shorter length than the tubular element 71. The cylindrical body 73 is mounted to the inside walls of the cylindrical tubular element 71 by means of a plurality of radial fins 74.

A peg 75 is inserted into the hollow interior of the cylindrical body 73. A concave element 76 having a diameter suitably larger than the internal diameter of the cylindrical tubular element 71 is mounted at the lower end of the peg 75. The upper end of the peg terminates with an enlarged part 751. A suitable threaded plug 78 is mounted on the corresponding threaded upper end of the cylindrical tubular element 71, resulting in a hermetic seal.

A suitable elastic element such as a spring or the like can be operatively connected between the cylindrical body 73 and the peg 75, in order to bias the peg 75 toward the outside (i.e. upwardly) to keep the concave element 76 pressed against the lower end of the cylindrical tubular element 71.

In use, the first channel 31 is filled with water and/or air, which is introduced into it through the port 7 after the plug 78 has been removed. When filled, the port 7 is reclosed hermetically by threading the plug 78 onto the tubular element 71.

When the inflow is completed, the resulting fluid inside the channel 31 will not be able to flow out of the port 7, because the pressure inside channel 31 will force the concave element 76 upwardly against the inner surface of the channel 31 so as to seal the port 7.

In order to evacuate the fluid from the channel 31, the plug 78 is removed, and the enlarged part 751 of the peg 75 is pressed downwardly so as to separate the concave element 76 from the inner surface of the channel 31 thereby opening the port 7 sufficiently to permit the outlet of the filling fluid. It is to be noted that the port 7 has been described in accordance with a preferred embodiment, any suitable known arrangements may be utilized so long as they can be easily controlled by the operator, and are capable of releasably blocking the opening in the channel 31.

The filling of the first channel 31 as described above, transforms the inventive mat, in a known manner, into a true and proper soft mattress that may be arranged on the bottom of a bathtub or similar basin, utilized for the purpose of water massage. As described above, a plurality of cups 6 will be mounted so that the mat will be immovably fixed in the bathtub or basin.

After the mat has been filled with fluid and mounted in the bathtub or basin, the free end of the feeder conduit 4 is then connected to a compressed air generator to provide compressed air which, as stated, may be treated, for example, by suitable ozonization and/or additives consisting of suitable fluids. The compressed air will flow from the feeder conduit 4 into the upper collector 322 so as to feed the longitudinal conduits or spaces 321. From these longitudinal conduits, the compressed air will flow out through the small holes 5, and penetrate into the water contained in the tub or basin so as to create the desired water massage effect.

The mat 1 can easily be detached from the tub or basin by detaching the cups 6 from the bottom surface of the tub or basin. Such removal allows the fluid contained in the first channel 31 to be emptied through the port 7. In order to empty this first channel 31, the plug 78 must be removed from the tubular element 71 and, as already described, the peg 75 must be pressed downwardly in order to move the concave element 76 downwardly so as to open the port 7 to allow discharge of the fluid from the first channel 31. At this point, the small mat 1 can be rolled up and the flat flexible pipe 41 wound around the resulting roll.

In this rolled up condition, the mat 1 and the attached flexible flat pipe 41 will occupy a very limited space, and attain all the advantages derived from the provision of such a compact unit.

Figure 5:
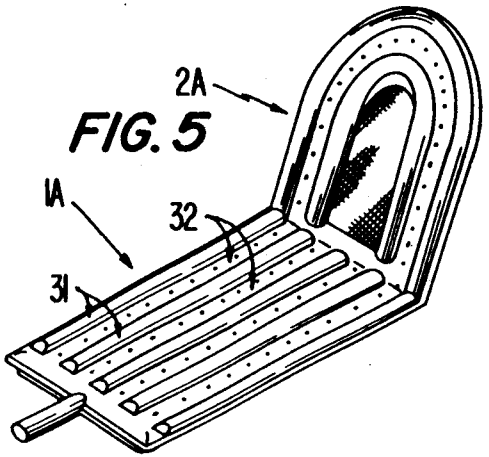
FIG. 5 is a perspective view of a water massage mat according to an alternative embodiment of the invention.
Figure 1:
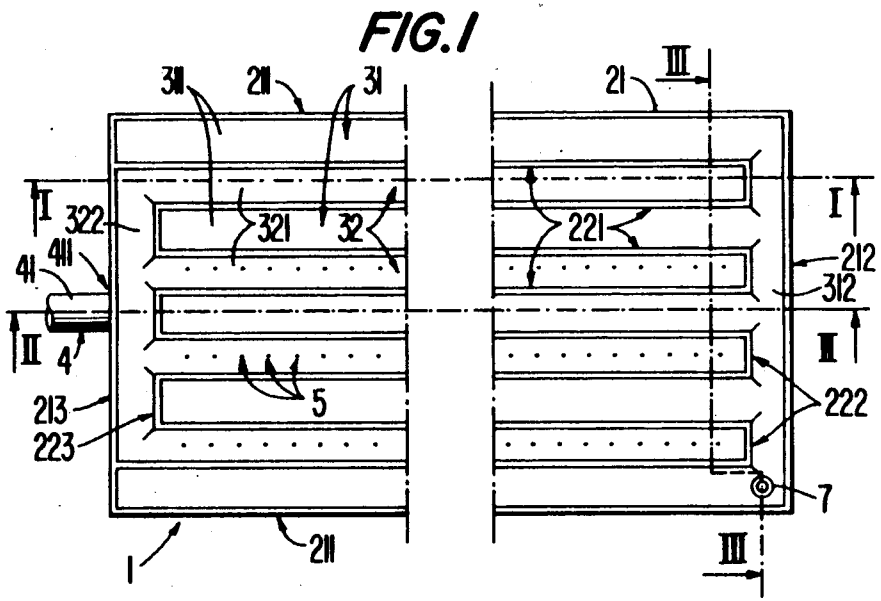
FIG. 1 is schedmatic plan view of a water massage mat according to the invention.
Figure 2:
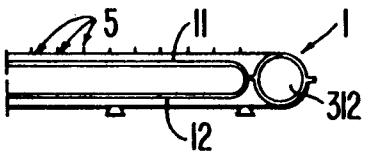
FIG. 2 is a cross-section view taken along the line I—I of FIG. 1.
Figure 3:
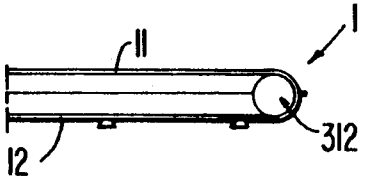
FIG. 3 is a cross-section view taken along the line II—II of FIG. 1.

As shown in FIG. 5, the mat can be advantageously shaped with a back part extending from one of its ends, so as to form a mat 1A having a backrest 2A.

The fundamental mat 1A is essentially the same as the previously described mat 1, with a backrest 2A formed in a manner similar to the mat 1A. At least one channel of the backrest 2A is interconnected with the first channel 31 of the mat 1A, such that when the mat 1A is inflated the backrest is also inflated and forms a soft structure that can be laid upon the inside face of the wall of the tub, so as to form a comfortable support for the spine of the user.

The construction of the backrest 2A may obviously be varied in many respects, and may also be provided with cups, similar to the cups 6, capable of attaching the backrest 2A to the wall of the tub or basin. It is also possible to interconnect a channel of the backrest with the second channel 32 of the basic mat 1A and to provide that channel of the backrest 2A with a plurality of small holes, so that a water massage effect can also be accomplished from the backrest 2A.

It is understood that these and other variations may be made to the water massage mat which is the object of this invention within the scope of the invention as defined only by the appended claims.

I claim:

1. A water massage mat comprising:

a soft and flexible cover formed of a pair of soft and flexible leaves interconnected by weld lines, said weld lines including a perimetrical weld line about a perimeter of said cover and inside weld lines for forming a first channel and a second channel distinct from said first channel, said first channel being hermetically sealed and said second channel having a plurality of small holes formed in a top surface thereof;

port means, formed in said first channel, for allowing said first channel to be filled with fluid and emptied of the fluid;

means for selectively sealing said port means;

conduit means for connecting said second channel to a compressed air source, such that compressed air can be fed into said second channel and can flow out through said small holes; and a plurality of suction cups mounted to a lower surface of said first channel for attaching said water massage mat to a surface of a tub;

wherein, when inflated, said first channel has a vertical dimension greater than a vertical dimension of said second channel so that said first channel is adapted to support the body of a user, and so that said top surface of said second channel is lower than a top surface of said first channel such that the body of the user can be supported on the first channel with a gap formed between the body of the user and said small holes formed in said top surface of said second channel.

2. A water massage mat as recited in claim 1, wherein said conduit means comprises a flat flexible pipe.

3. A water massage mat as recited in claim 2, wherein said flat flexible pipe is welded to said cover for communication with said second channel.

4. A water massage mat as recited in claim 1, wherein said cover is configured and said conduit means is arranged such that said cover can be rolled up and said conduit means can be wound around said cover.

5. A water massage mat as recited in claim 1, wherein said leaves are formed of elastomeric laminates.

6. A water massage mat as recited in claim 1, wherein said leaves are formed of natural rubber.

7. A water massage mat as recited in claim 1, wherein said leaves are formed of synthetic rubber.

8. A water massage mat as recited in claim 1, wherein said leaves are covered with cloth.

9. A water massage mat as recited in claim 1, wherein said weld lines comprise heat weld lines.

10. A water massage mat as recited in claim 1, wherein said weld lines comprise ultrasonic weld lines.

11. A water massage mat as recited in claim 1, wherein as viewed from above, said inside weld lines form a serpentine shape.

12. A water massage mat as recited in claim 1, further comprising a backrest connected to said cover at one end thereof.

13. A water massage mat as recited in claim 12, wherein said backrest comprises a backrest cover formed of a pair of soft and flexible backrest leaves interconnected by welded lines.

14. A water massage mat as recited in claim 13, wherein said weld lines interconnecting said backrest leaves are arranged to form a third channel; and said third channel is in fluid communication with said first channel.

15. A water massage mat as recited in claim 14, wherein said weld lines interconnecting said backrest leaves are further arranged to form a fourth channel; and said fourth channel is in fluid communication with said second channel.

16. A water massage mat as recited in claim 15, wherein a plurality of small holes are formed in a surface of said fourth channel.

* * * * *